US005505240A

United States Patent [19]

Horne, Jr. et al.

[11] Patent Number: 5,505,240

[45] Date of Patent: Apr. 9, 1996

[54] METHOD AND APPARATUS FOR THE TREATMENT OF LOGS

[75] Inventors: Roger B. Horne, Jr., Bremerton, Wash.; Piotr D. Moncarz, Palo Alto, Calif.

[73] Assignee: The Failure Group, Inc., Menlo Park, Calif.

[21] Appl. No.: 404,867

[22] Filed: Mar. 15, 1995

[51] Int. Cl.[6] ..... B27M 1/00

[52] U.S. Cl. ..... 144/329; 144/2 R; 144/208 R; 144/340; 144/342; 144/380; 427/315

[58] Field of Search ..... 427/315, 317, 427/351, 374.1, 382, 440, 329; 144/340, 342, 364, 380, 271, 2 R, 208 R, 281

[56] References Cited

U.S. PATENT DOCUMENTS

| | | | |
|---|---|---|---|
| 979,914 | 12/1910 | Ayer . | |
| 2,799,308 | 7/1957 | Makinson . | |
| 2,881,814 | 4/1959 | Avard . | |
| 2,995,164 | 8/1961 | Bott | 144/342 |
| 3,101,757 | 8/1963 | Hanson . | |
| 4,194,033 | 3/1982 | Mofpl | 427/351 |
| 4,325,993 | 4/1982 | Schroder | 427/315 |
| 4,640,327 | 2/1987 | Krilov | 144/346 |
| 5,103,883 | 4/1992 | Viikari et al. | 144/342 |

OTHER PUBLICATIONS

"Foreign Timber and Timber Products", Plant Protection and Quarantines, Prt Operations Staff—Dec. 1, 1993–PPQ Oprtnl Gdlnes.

Logheat: a computer program for determining log heating times for frozen and nonfrozen logs; *Forest Products Journal,* 1987, Nov./Dec., vol. 37, No. 11/12.

Heating Time Charts for Frozen and Nonfrozen Veneer logs; *Forest Products Journal,* Apr. 1980, vol. 30, No. 4.

"Wood Handbook", U.S. Department of Agriculture, vol. 72 pp. 89–93 & 103–104.

"Wood handbook: Wood as an engineering material"; Agriculture Handbook No. 72, Forest Products Laboratory, 1974. (pp. 4–33 to 4–40).

"Effect of high–temperature drying on bending strength of yellow–poplar 2 by 4's"; *Forest Products Journal;* vol. 33, No. 2 by C. C. Gerhards (p. 61).

"Heating Rates for Logs, Bolts, and Flitches to Be Cut into Veneer"; H. O. Fleischer, Forest Products Laboratory–Rept. 2149 (p. 1).

"Accelerated Aging: Residual Weight and Flexural Properties of Wood Heating in Air at 115° to 175° C." *Wood Science,* vol. 4, No. 4., by M. Millett/C. Gerhards (p. 39).

"Effect of High–Temperature Drying on Tensile Strength of Douglas–fir 2 by 4's"; *Forest Products Journal,* vol. 39, No. 2 by C. Gerhards (p. 39).

"Effect of Moisture Content and Temperature on the Mechanical Properties of Wood: an Analysis of Immediate Effects"; Nov. 15, 1980 . . . Forest Products Laboratory, by C. Gerhards. (p. 1).

*Primary Examiner*—W. Donald Bray
*Attorney, Agent, or Firm*—Myers, Liniak & Berenato

[57] ABSTRACT

An apparatus and method for the hot water treatment of debarked logs to eliminate infestation and fungi in the logs is presented. The present invention utilizes a water tank and a heat generation source to raise the temperature of the center of the logs above a predetermined level for a sufficient time to accomplish this purpose.

29 Claims, 4 Drawing Sheets

METHOD AND APPARATUS FOR THE TREATMENT OF LOGS

BACKGROUND OF THE INVENTION

This invention relates to a method and apparatus for the treatment of timber products. More specifically, the present invention relates to a method of treating debarked logs by immersing the logs in a hot water bath for an extended time period for the purposes of killing insects and fungi that may be on or in the logs themselves.

In recent years, the demand for timber and wood products made therefrom has been steadily increasing throughout the world. In the United States domestic timber production currently is insufficient to meet this rising level of demand. As a result, timber produced abroad has emerged as a valuable and highly marketable commodity.

Certain insects and fungi can seriously impact the health of forests to the point of killing trees or making the wood undesirable for use. Forests in the United States are not necessarily infested with the same insects and fungi as found in forests of other countries. There is particular concern that imported timber from other countries might introduce new harmful insects or fungi to United States forests.

In order to address these issues, the Plant Protection and Quarantine division of the United States Department of Agriculture has implemented extensive operational guidelines, that apply to foreign timber and timber products that are imported into the United States. These guidelines apply to all hardwood and softwood logs and require certain steps to be performed prior to importation. First, these logs must be debarked. An average of 98% of the bark must be removed with no single log retaining bark on more than 5% of its surface. Next, the center of each debarked log must have been heated to at least 56° C. (approx. 132.8° F.), for thirty minutes. Immediately after the heat treatment, the logs must be safeguarded against reinfestation by either physically protecting or chemically treating the logs. These prophylactic chemical treatments must be repeated at least every thirty days until the logs are shipped to the United States.

Due to the heat transfer and thermal properties of the logs, a significant problem is presented in attempting to bring the center of the log to a temperature of at least 56° C. for thirty minutes, as required by the U.S.D.A. guidelines. Known prior art methods have applied dry heat to logs by raising the temperature of the ambient air surrounding the logs to meet this requirement. Such techniques, however, have suffered from several rather significant drawbacks. Generating the quantity of dry heat needed in order to attain the appropriate internal temperature in the center of a succession of logs of 56° C. for thirty minutes causes a tremendous amount of energy to be consumed. In addition to their high cost of operation, such heat generating sources are costly and time consuming to construct and are often located great distances from where the timber is harvested.

In addition to the energy cost issue, utilization of dry heat in systems as a solution to infestation problems may introduce other new problems into the logs so processed. Kilns or other devices that are used in dry heat treatment of logs generally raise the ambient air surrounding logs to be processed to between 185° and 240°, for extended periods of time. It has been found that the application of such high temperature dry heat can cause significant strength losses in many wood species. Such systems have at times had rather detrimental effects on the structural properties of the logs processed thereby, by reducing tensile strength or introducing shrinkage, warping and/or checking.

There has been no use of hot water to treat logs to rid them of insects and harmful fungi in order to meet the U.S.D.A. requirements. There have been uses of heated water for short durations, usually about 35 minutes, but only for the sole stated purpose of loosening the bark for subsequent debarking.

None of these prior art methods has taught submerging completely debarked logs within a hot water bath, for an extended period of time, for the purposes of ridding logs of any infestation or fungi. As such, these prior art hot water methods failed to provide an adequate solution to the problem at hand. As a result, the need exists in the art for a system capable of heating the center of debarked logs to at least 56° C. for thirty minutes in a cost and energy efficient manner that does not significantly weaken or compromise the structural and physical properties of the logs so processed.

Coincidentally, in several regions of the world that have extensive timber resources, such as certain parts of the former Soviet Union, the end of The Cold War has resulted in a vast stockpile of military hardware that is currently completely unused. There is a great desire in countries where this military hardware exists, to attempt to convert the tremendous investment that has already been made in such hardware to productive peacetime commercial uses. Once example of this is the many ships and submarines, that are no longer in service, that have nuclear or fossil fuel power plants that are currently mothballed in ports around the world. A further need therefore exists to adapt such unused military hardware to solve power and heat generation problems.

SUMMARY OF THE INVENTION

It is an object of the present invention to eliminate disadvantages of prior methods and provide an improved method and apparatus for heat treating debarked logs to rid them of infestation and fungi, that is more energy efficient, cost effective and introduces significantly fewer adverse effects into the finished wood products so treated than presently existing systems.

It is another object of the present invention to provide an improved method and apparatus for the heat treatment of debarked logs that utilizes heated water in order to raise the internal temperature of the logs.

Accordingly, one aspect of the present invention is to provide an apparatus and method for heat treating logs to eliminate infestation and fungi in debarked logs, wherein, such logs are submerged in a hot water bath for an extended period of time, in order to raise the temperature at the center of the logs to at least 56° C. for thirty minutes.

It is a further object of the present invention to provide a method and apparatus that is capable of the hot water treatment of debarked logs to eliminate infestation and fungi that is equally capable of utilizing either existing steam or heat generating sources and water containment facilities, or newly constructed sources or facilities, in order to raise and maintain an adequate temperature of water in order to treat logs to meet current regulatory requirements.

In one embodiment of the invention, the means for generating elevated temperatures in the hot water bath and maintaining these temperatures therein is the secondary steam or heat generated from a ship or submarine's nuclear or fossil fuel power plant. In accordance with other aspects of the invention, there are provided a variety of different means for introducing the logs through the hot water bath system. In another embodiment of the invention, an existing dry dock facility is utilized as the hot water bath that the logs are immersed in for treatment.

These and other objects and aspects of the present invention are accomplished by a method and apparatus for the eradication of infestation and fungi in debarked logs utilizing a hot water bath by providing a volume of water in a containment facility, introducing a plurality of debarked logs into the containment facility and submerging the logs completely below the surface of the water, heating the water for a time and temperature sufficient to substantially eliminate infestation and fungi therein and thereafter removing the logs from the containment facility.

BRIEF DESCRIPTION OF THE DRAWINGS

Embodiments of the invention will now be described by way of example, with reference to the accompanying drawings in which.

DETAILED DESCRIPTION OF THE INVENTION

Figure 1:
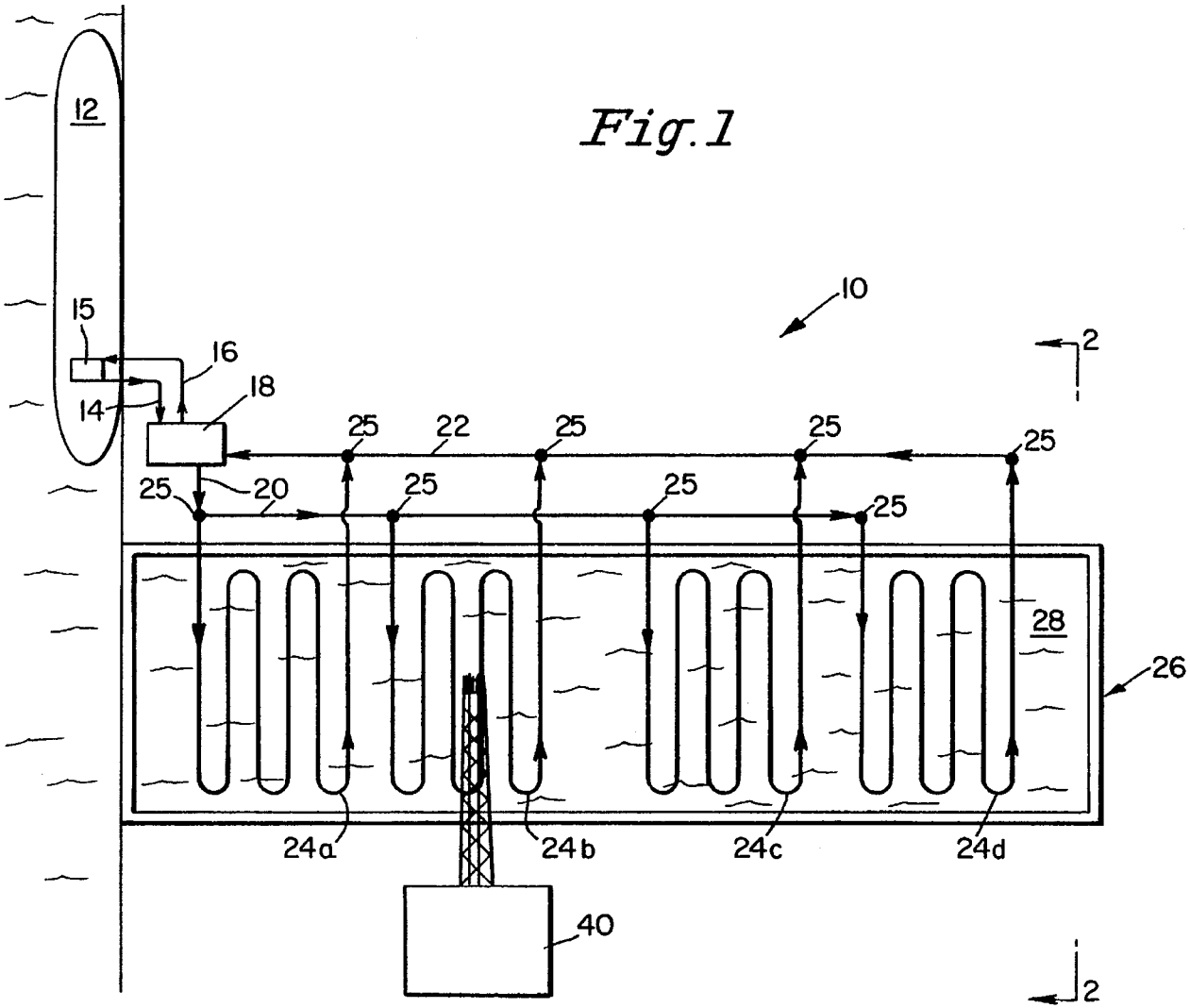
FIG. 1 is a diagrammatic plan view of an embodiment of the present invention.

In contrast to prior art systems, the present invention immerses the logs in hot water rather than hot air, in order to raise the temperature of the logs to a sufficient level to rid them of any infestation or fungi. Water is preferred as a heating medium because it exhibits superior thermal transfer characteristics and introduces fewer adverse structural and cosmetic effects into the logs so processed than air.

All of the embodiments of the present invention utilize a heat generating source, a tank or water containment facility where the logs are immersed, a system for delivering the heat from the source to the water in the tank to achieve proper heating of the water and a mechanism for introducing and removing logs from the hot water in the tank. The benefits of this system for the hot water treatment of logs can be realized using newly constructed nuclear or fossil fuel heat generating sources and water baths specifically designed for this purpose. However, an added advantage of the present invention is that the same benefits are also attainable by adapting it to heating and water containment facilities initially designed for other far different purposes.

A power source is required to generate sufficient heat in the form of superheated or saturated steam in order to heat the water in the tank which the logs will be immersed in to a temperature of about 150° to 200° F. As previously mentioned, in some areas of the world where the supply of timber far exceeds the demand, there also exists a relatively ready supply of mothballed warships, many of which have nuclear or fossil fuel power plants on board. The cost of utilizing such a ship or submarine, as a heat or steam generating power source for the present invention, is rather minimal since the capital expenditure for these ships has already been made and yet they still exist and are completely unused.

A particularly preferred alternative is provided in the case of an existing nuclear powered ship or submarine. Such ships require no additional fuel and can be inexpensively operated by a skeleton crew large enough to operate only the power plant of the ship or submarine. In this manner, an otherwise expensive steam generating power source can be provided and operated for a comparative fraction of the cost of building and operating a new fossil fuel or nuclear powered steam generating facility. In order to generate a sufficient amount of heat to raise and maintain the water temperature in a bath or dry dock having a volume of about 1,000,000 to 1,500,000 cubic feet at an adequate level, a power plant capable of generating about 15–50 thousand horsepower is necessary. Most nuclear powered ships and submarines meet this criteria.

Further cost savings can be realized in accordance with the present invention by utilizing a dry dock as the containment facility in which the water will be heated and the logs will be deposited for treatment. These dry dock facilities avoid the substantial construction costs associated with building a new water bath having a volume potentially as large as 1,000,000 to 1,500,000 cubic feet or larger. Additionally, the location of such dry docks allows a ship or submarine to be brought in close proximity thereto to be used as the heat generating source for water contained in the dry dock.

Figure 2:
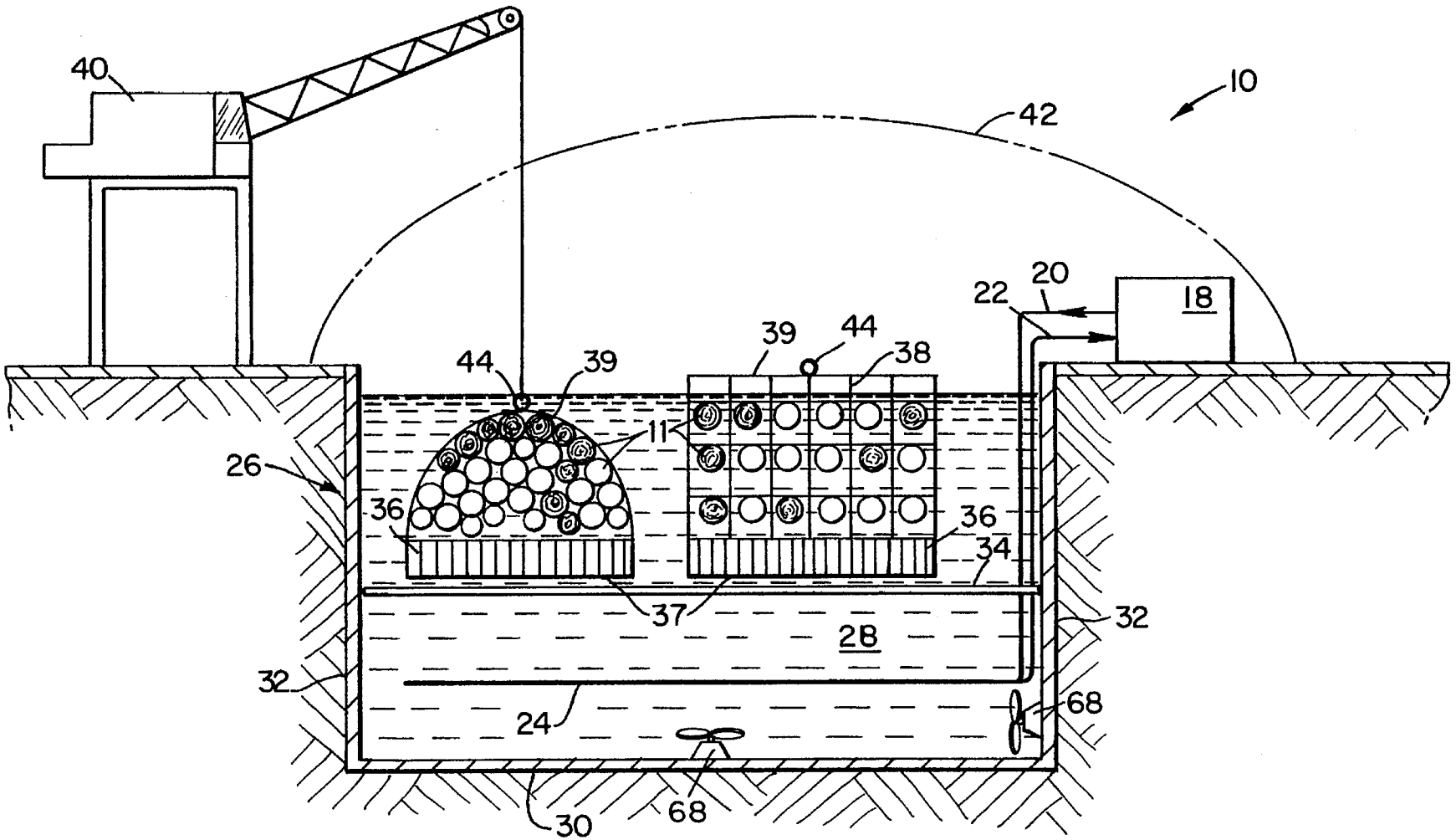
FIG. 2 is a sectional end view of the embodiment of the invention illustrated in FIG. 1 taken along the line 2—2 of FIG. 1.

Referring now to FIGS. 1 and 2, one embodiment of the apparatus 10 for the hot water treatment of previously debarked logs in accordance with the present invention is illustrated. In this embodiment, a ship 12, such as a nuclear powered submarine, is used as the heat generating source, and a dry dock 26 functions as a water immersion tank for the logs 11. Depending on the design of the particular nuclear primary plant 15, temperatures are achieved that produce superheated or saturated steam in the ship's secondary plant. Steam from the secondary plant can be supplied by a supply line 14 directly to the supply conduit 20 coils 24 in the dry dock 26 to heat the water or if further isolation from the ship 12 is desired a heat exchanger 18 can be used to transfer the heat from the secondary plant to another system which will circulate steam through the coils 24 in the dry dock 26. The coils 24 will heat the water 28 to a desired temperature level between 150° F. and 200° F.

The coil supply conduit 20 carries the steam from either the heat exchanger 18 or the steam supply line 14 to a plurality of heating coils referenced generally at 24*a*, 24*b*, 24*c* and 24*d*. The heating coils 24 are each connected at one end to the coil supply conduit 20 and at the other end to the heating coil return conduit 22 in a closed loop arrangement. The heating coil return returns the condensate either to the heat exchanger 18 or the ship 12 for subsequent reheating and recirculation. The steam lines 14 and 16, conduits 20 and 22 and coils 24 can be constructed of any standard piping material that exhibits good heat transfer characteristics.

The coil supply 20, coil return 22 and coils 24 are preferably provided with a plurality of pressure and temperature regulating valves 25 in order to maintain proper temperature throughout the coils 24. This promotes uniform heating of the water 28 and logs 11 in the dry dock 26. The power plant 15 of the ship 12 is capable of providing pressurized steam through the coils 24 in a consistent manner at preferred temperatures of between about 400°–500° F. or greater if the plant is designed to use superheated steam. The coils 24 are arranged throughout the dry dock so as to insure relatively even heating of the water 28 throughout the dry dock 26. The design arrangement and cross sectional configuration of the coils 24 can all be varied. The construction and layout of the coils 24 in a particular circumstance depends in large measure upon the size and dimensions of the dry dock 26.

As particularly illustrated in FIG. 2, it is desired that the coils 24 be located a sufficient distance from the bottom 30 of the dry dock 26 to allow for circulation of the water 28 around and through the coils 24. If increased circulation of the water 28 in the dry dock 26 is desired, one or more flow generating pumps 68 may be located on the floor 30 or the sides 32 of the dry dock 26. These pumps 68 can serve to increase the flow of water 28 through the coils 24 and the logs 11 submerged in the water 28. A log support 34 is submerged in the dry dock 26 in order to provide a base for the logs 11 to be treated and keep them from contacting or damaging the coils 24. The support 34 also insures that insertion of the logs into the dry dock 26 does not impair water circulation around the coils 24.

Both the diameter of the logs 11 and the way that they are packed together can have significant effects on the time and amount of heat required to provide proper treatment. It is therefore most preferred that logs 11 introduced simultaneously into the water 28 be of approximately the same diameter and that they are not tightly packed against each other to accomplish substantially even treatment. In addition, in order for the logs 11 to be processed in accordance with the present invention, it is preferred that they remain completely submerged in the heated water at all times until the center of each log reaches a temperature of at least 56° C. for thirty minutes.

To accomplish these goals, ballasted platforms can be are used to keep the logs 11 submerged and to facilitate their introduction into and removal from the water 28. Such platforms 36 can come in a variety of types and sizes and allow a large number of logs 11 to be introduced and removed from the bath simultaneously. The bottoms 37 of the platforms 36 are weighted in order to retain them on the base 34 well below the surface of the water 28 in the dry dock 26 and overcome the buoyancy of the logs 11.

The platforms 36 also have retainers 39 that keep the logs in a relatively fixed position and restrict them from freely floating to the surface once they are introduced into the water 28. It is often important to insure that water flows relatively evenly around each of the logs 11 submerged in the water 28 on a platform 36. A log spacer 38 can be utilized to maintain the logs 11 in a uniform spaced configuration during their treatment.

The platforms 36 can be introduced and removed from the water 28 in a batch process or by a continuous system such as a conveyor, as will be described later in detail. If a batch process is preferred, connectors 44 allow the platforms 36 to readily be lowered into the dry dock 26 for treatment and then removed once the treatment is complete. It is common to find one or more cranes 40 in the vicinity of the dry dock 26 capable of lifting and positioning heavy objects such as the platforms 36 containing logs 11. As such, the utilization of dry docks 26 in connection with the present invention can afford an additional potential cost savings advantage.

Most dry docks 26 are constructed and situated such that the bottom 30 and the sides 32 thereof exhibit a relatively low degree of heat loss. Since the top of the dry dock 26 is open, some heat will be lost from the water 28 due to the difference in temperature between the ambient air and the water 28 in the dry dock 26. This heat loss is usually rather minimal given the heat generating ability of the power plant 15 and the insulating characteristics of the bottom 30 and sides 32 of the dry dock 26.

If, in particularly cold climates or for other reasons, it is desired to reduce heat loss caused by the interaction of the ambient air and the surface of the water 28 in the dry dock 26, then an overstructure 42 can be provided with removable or sliding sections to enclose the entire dry dock 26. The cover can be moved when it is desired to use the crane 40. The overstructure 42 provides an air temperature at the surface of the water 28 in the dry dock 26 that is substantially closer to the temperature of the water 28 than that of the ambient outside air.

Figure 3:
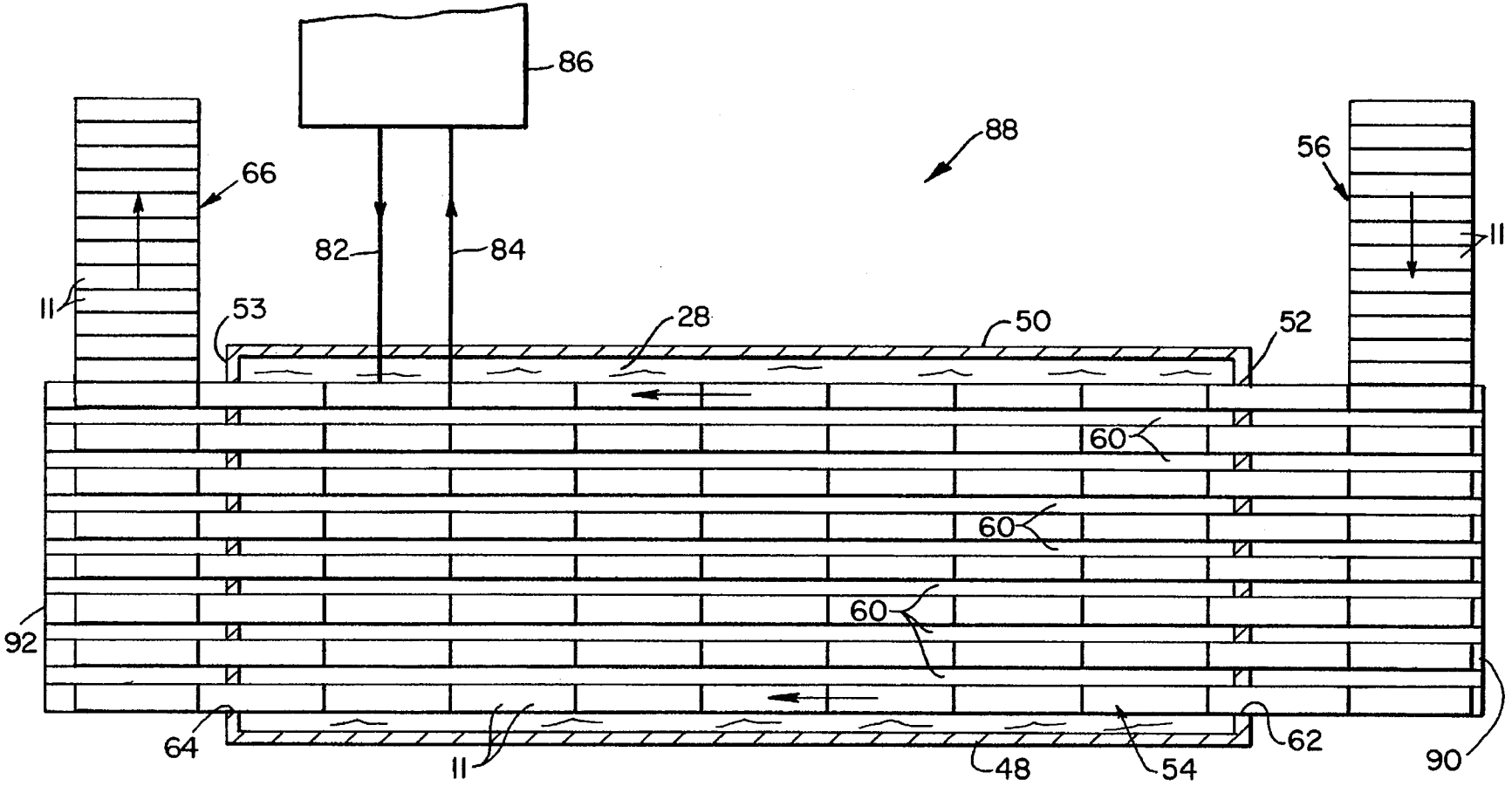
FIG. 3 is a plan view of another embodiment of the present invention utilizing a closed hot water bath and a log handling and transfer system.

Another embodiment of the present invention is illustrated in FIG. 3 and generally referred to as 88. In this embodiment, a modified water bath 48 is utilized that features a closed top 50 that acts to lessen the amount of heat loss from the water therein 28 by isolating it from the ambient air surrounding the bath 48. Such a water bath 48 can be either constructed specifically for this purpose, or an existing dry dock as previously described can be modified in accordance with this design.

The water bath 48 features a plurality of inlet openings 62 in one sidewall 52 and a plurality of corresponding outlet openings 64 in an opposite sidewall 53 of the bath 48. The water 28 in the bath 48 is heated by coils 24 containing steam as previously described. Steam is fed from a steam generating source 86 such as a fossil fuel power plant or a nuclear or fossil fuel power plant of a ship as previously described. The steam generated by the power source 86 is circulated to the bath 48 through the steam supply pipe 82 and steam return pipe 84 respectively.

Conveyors 60 are provided that serve to move a succession of debarked logs 11 through the water bath .48 from the inlet end 90 to the outlet end 92. The conveyors 60 can be operated at different speeds and can also be selectively stopped. This allows the logs 11 to be moved into the water bath 48, retained in a stationary position within the bath 48 for a period of time sufficient to allow proper heat treatment to occur and removed from the bath 48 after treatment.

The conveyors 60 can be constructed to handle either a single log 11 or a number of logs 11 across their respective widths in a spaced parallel arrangement. The regularity of the spacing of the conveyors 60 within the bath 48 insures that the water bath 48 can be used to treat the logs 11 to its greatest capacity and also insures that the flow and circulation around all of the logs 11 contained thereon is approximately even. If desired, increased circulation and flow of water can also be provided through optional spaced openings or perforations in the conveyors 60.

FIG. 3 further illustrates preferred log transfer system 56 and log removal system 66 for use with the present invention. The log transfer system 56 vertically aligns a succession of logs 11 and delivers them to the several tiers of conveyors 60. The conveyors 60 can then move the logs 11 into the bath 48 and retain them in a consistent, orderly and regular configuration for treatment. The log removal system 66 functions similarly to the log transfer system 56 and is located near the output end 92 of the bath 48. The removal system 66 serves to remove treated logs 11 from the various conveyors 60 located within the bath 48 and move them away from the bath 48 in a consistent, orderly and efficient manner for subsequent handling. The transfer system 56 and removal system 66 can either introduce single or multiple columns or rows of logs 11 onto the parallel conveyors 60 and subsequently remove them. Together the transfer system 56, conveyors 60 and removal system 66 allow for continuous efficient delivery of a series of logs 11 through the bath 48 for treatment without the use of cranes or other material handling devices.

Figure 4:
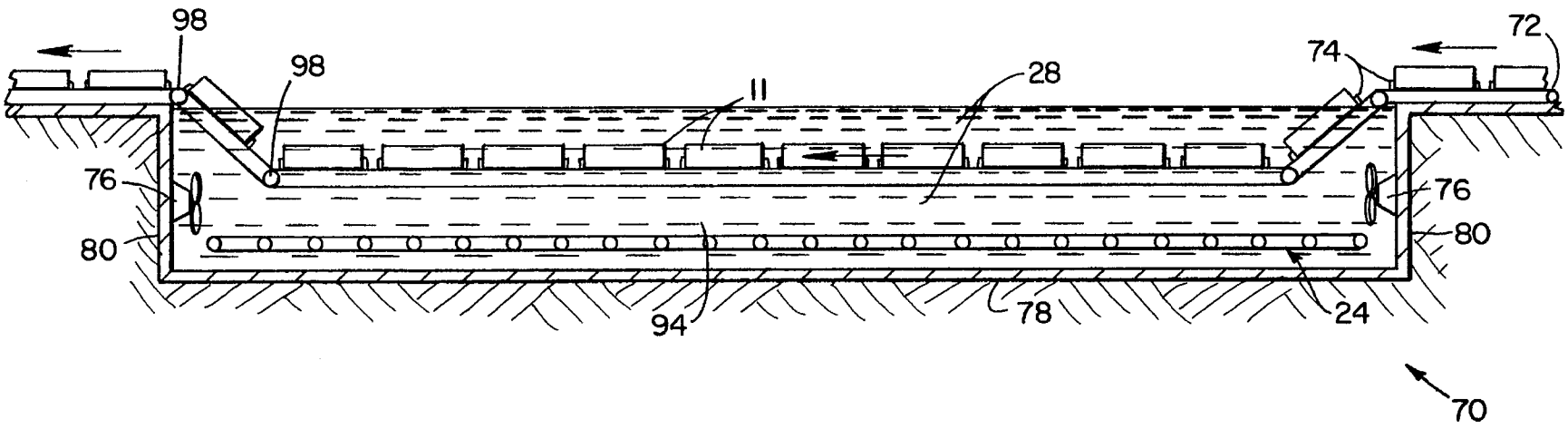
FIG. 4 is a side sectional view of another embodiment of the present invention utilizing a single continuous conveyor system.

Turning now to FIG. 4, another embodiment of the present invention is illustrated. Like the previously described embodiments, a hot water bath 94 is utilized that has a series of spaced coils 24 therein. Steam is circulated through the coils 24 in order to heat the water 28 in the bath 94. In this embodiment, an alternative log delivery system 70 is provided. The system 70 features a conveyor 72 that is provided with locking and spacing members 74 running along its surface at spaced intervals. These members 74 serve to retain either debarked logs 11 or other material handling devices adapted to contain logs 11 on the conveyor 72 in an orderly, regular and spaced manner.

As illustrated, the conveyor 72 can move a series of logs 11 from a location outside and above the water 28 to a location in the bath 94 below the surface of the water 28 and subsequently out of the bath 94. The conveyor 72 is capable of variable speed movement. In addition, the conveyor 72 is constructed of a material flexible enough to allow it to bend to sufficiently introduce and remove the logs 11 into and from the bath 94 as illustrated. In the alternative, the conveyor 72 is provided with a plurality of pivoting hinges 98 at spaced intervals along its length, in order to allow the logs 11 on the conveyor 72 to be lowered into the bath 94 and subsequently raised out of the bath 94 after treatment.

If additional circulation is desired within the bath 94, one or more flow generators 76 can be located on the walls 80 or bottom 78 of the bath 94. Similarly, the conveyor 72 can be provided with perforations, if it is desired to allow the water 28 to flow therethrough. Depending upon the capacity desired, the bath 94 can be provided with a series of spaced conveyors 72. Alternatively, the width of the conveyor 72 can be designed to accommodate either a single or multiple logs 11 across its width in spaced parallel rows.

The following example further illustrates the advantages of the present invention:

EXAMPLE

A ship having a nuclear reactor with a 45,000 horsepower boiler is utilized as the steam heat generating source. Using "Q" to represent the total heat available from the boiler, the following calculations are made to estimate the total equivalent thermal output of the boiler.

$$Q_{in} = 45000 \cdot 33475 \frac{\text{BTU}}{\text{hr}}$$ 45,000 hp boiler $$Q_{in} = 441.5 \text{ MW}$$ Equivalent thermal output $$\text{MW} = 10^6 \text{ watt}$$ Unit definition It is then assumed that 80% of the thermal energy generated by the boiler would be transferred to water in a dry dock and that this would represent the total thermal energy available to heat the water in the dock.

$$Q_{net} = 0.8 \cdot Q_{in}$$ Assume 80% of thermal energy tranferred to water in the dry dock.

A dry dock is utilized having the following dimensions:

$L = 400$ ft
$W = 80$ ft
$H = 40$ ft
$t = 6$ ft

Nominal dimensions of dry dock

The dry dock would be substantially constructed of concrete and the thermal parameters for that concrete, water, wood and air are set forth below, with the variable "ρ" used to refer to density and a variable "$C_p$" designating specific heat.

$$\rho_{con} = 2000 \frac{\text{kg}}{\text{m}^3} \quad \rho_{wood} = 400 \frac{\text{kg}}{\text{m}^3}$$
$$\rho_{water} = 1000 \frac{\text{kg}}{\text{m}^3} \quad \rho_{air} = 1.31 \frac{\text{kg}}{\text{m}^3}$$

Thermal parameters for concrete, water, wood, and air (Ref. 1).

$$Cp_{con} = 880 \frac{\text{joule}}{\text{kg} \cdot \text{K}} \quad Cp_{wood} = 2010 \frac{\text{joule}}{\text{kg} \cdot \text{K}}$$
$$Cp_{water} = 4200 \frac{\text{joule}}{\text{kg} \cdot \text{K}} \quad Cp_{air} = 1003 \frac{\text{joule}}{\text{kg} \cdot \text{K}}$$

(Concrete Cp from Ref. 3)

$$K_{wood} = 0.20 \frac{\text{watt}}{\text{m} \cdot \text{K}}$$ Thermal conductivity of wood ("wet wood")

Next, it is necessary to determine the external heat loss from the system with the facility at temperature. The dry dock in the present example has a building enclosing it, in order to minimize heat loss due to contact between the water and the ambient air surrounding the dry dock. The overall heat transfer coefficient for the building walls and the roof is arrived at by determining the thermal resistance of the building "$R_{bldg}$" and the heat transfer "$U_{bldg}$" which is equal to the effective heat loss per square foot, as set forth below:

$$R_{bldg} = \frac{10 \text{ ft}^2 \cdot \text{hr} \cdot \text{R}}{\text{BTU}}$$ Overall heat transfer coefficient for building walls and roof $$U_{bldg} = \frac{1}{R_{bldg}}$$

$$H_{bldg} = 30 \text{ ft}$$ Assumed height of building $$L_{bldg} = L + 40 \text{ ft}$$ Building assumed to be 20 feet longer and wider than the dry dock on each side.

$$W_{bldg} = W + 40 \text{ ft}$$

$$A_{bldg} = 2 \cdot (L_{bldg} \cdot H_{bldg} + W_{bldg} \cdot H_{bldg}) + L_{bldg} \cdot W_{bldg}$$ Surface area of building The temperature gradient between the air inside the building and outside the building is 80°.

$$\Delta T_{bldg} = 80\ R$$ Assumed temperature gradient, inside air vs. outside air.

$$Q_{wall} = U_{bldg} \cdot U_{bldg} \cdot \Delta T_{bldg}$$ Heat loss that must be compensated for $$Q_{wall} = 2.026 \cdot 10^5 \text{ watt}$$

There is also a heat loss due to infiltration or leakage of air from outside the building to the inside of the building. The heat loss due to such infiltration is set forth below:

$$ACH = \frac{2.0}{\text{hr}}$$ Nominal infiltration rate at two air changes per hour $$V_{bldg} = L_{bldg} \cdot W_{bldg} \cdot H_{bldg}$$

-continued $$\text{Flux}_{\text{bldg}} = V_{bldg} \cdot ACH \cdot \rho_{\text{air}}$$

$$\Delta T_{air} = 80\ R$$

$$Q_{inf} = \text{Flux}_{\text{air}} \cdot Cp_{air} \cdot \Delta T_{air}$$

$$Q_{inf} = 1.455 \cdot 10^6 \text{ watt}$$

The volume of concrete and water to be heated is determined:

$$V_{con} = 2 \cdot (L \cdot H + W \cdot H) \cdot t + L \cdot W \cdot t$$

Packing = 0.5 — 50% of volume assumed to be logs, therefore water accounts for only half of the volume of the empty dry dock.

$$V_{water} = L \cdot W \cdot H \cdot \text{Packing}$$

The mass of the concrete and the water are then determined as follows:

$$M_{con} = V_{con} \cdot \rho_{con}$$

$$M_{water} = V_{water} \cdot \rho_{water}$$

The time necessary to heat the water and concreted taking into account the heat loss through the walls and infiltration loss from the building at steady state values, is then calculated. Note that the heat loss through the dry dock walls and bottom are neglected since they are believed to be minimal. The water is heated from an initial temperature of 30° F. to 160° F.

$\Delta T = 130\ R$ — From 30° F. up to 160° F.

$$\text{Time} = (M_{con} \cdot Cp_{con} + M_{water} \cdot Cp_{water}) \cdot \frac{\Delta T}{(Q_{net} - Q_{wall} - Q_{inf})}$$

Time = 5.5 hr

With the ambient water bath temperature of 160° F., the time to heat the center line of the log to 132° F. (≈56° C.) is calculated. This calculation assumes that water flow over the logs produces minimal external resistance to heat transfer when compared with internal heat transfer resistances. This limiting case has the inverse Biot number set equal to zero.

$T_o = (460 + 160) \cdot R$ — Ambient (water bath) temperature, 160° F.
$T_i = (460 + 30) \cdot R$ — initial temperature of log, 30° F.
$T_f = (460 + 132) \cdot R$ — desired final temperature of log, 132° F.

$$\Theta = \frac{T_f - T_o}{T_i - T_o} \qquad \Theta = 0.215$$

$Fo(\Theta) = 0.044 - 0.222 \cdot In(\Theta)$ — With no external heat transfer resistance ($Bi^{-1} = 0$), fit to the Fourier number vs theta.

The thermal diffusivity of the logs is calculated in order to determine the internal temperature resistance of the logs utilizing the result for thermal diffusivity. The time required to heat the center line of logs having diameters of 8", 12" and 20" respectively, in water having the ambient temperature of 160° F., is as follows:

$$\alpha = \frac{K_{wood}}{\rho_{wood} \cdot Cp_{wood}}$$

-continued $$\tau(D) = \left(\frac{D}{2}\right)^2 \cdot \frac{Fo(\Theta)}{\alpha}$$

τ(8 in)=4.4 hr
τ(12 in)=10 hr
τ(20 in)=27.7 hr

The above calculation is repeated below, using an ambient water temperature of 180° F., rather than 160° F.

$T_o = (460 + 180) \cdot R$ — Ambient (water bath) temperature, 180° F.

$$\Theta = \frac{T_f - T_o}{T_i - T_o} \qquad \Theta = 0.320$$

$Fo(\Theta) = 0.044 - 0.222 \cdot In(\Theta)$ — With no external heat transfer resistance ($Bi^{-1} = 0$), fit to the Fourier number vs theta.

The time required to bring the center line of the logs to 132° F., with the water at 180° F., is as follows:

$$\tau(D) = \left(\frac{D}{2}\right)^2 \cdot \frac{Fo(\Theta)}{\alpha}$$

τ(8 in)=3.4 hr
τ(12 in)=7.7 hr
τ(20 in)=21.4 hr

The throughput rate of the logs depends strongly on the packing factor of the logs, as well as the process and time associated with the process for introducing and removing logs into the water bath. The following assumptions are used for this process:

1. A packing factor of 0.5 is used, where 50% of the total volume consists of logs.
2. The loading and unloading time for the logs is simply added to the result for heating, as below.
3. 30 minutes is allowed with the logs at temperature.
4. A water temperature of 160° F. is assumed.

$\tau_{load} = 24$ hr — 24 hours to load the facility
$\tau_{unload} = 24$ hr — 24 hours to unload the facility The throughput rate of logs per day is then determined as follows, with values for logs of 8", 12" and 20" diameters respectively:

$$\text{Logs}(D) = L \cdot W \cdot H \cdot \frac{\text{packing}}{(\tau_{load} + \tau_{unload} + \tau(D) + 30 \cdot \text{min})}$$

$$\text{Logs (8 in)} = 8377 \frac{\text{m}^3}{\text{day}}$$

$$\text{Logs (12 in)} = 7739 \frac{\text{m}^3}{\text{day}}$$

$$\text{Logs (20 in)} = 6223 \frac{\text{m}^3}{\text{day}}$$

The foregoing example demonstrates that a steam generating source, such as a nuclear or fossil fueled power plant on a ship, can be utilized in conjunction with a dry dock in order to efficiently raise the temperature of the center line of logs of varying diameters to 132° F. for thirty minutes, as required by U.S.D.A. guidelines, in a cost efficient manner. This example is only illustrative of one embodiment of the invention and is not meant to be limiting.

I claim:

1. An apparatus for the heat treatment of debarked logs to eliminate infestation and fungi therein, comprising:

means for containing a volume of water having a plurality of debarked logs therein;

means for generating heat;

means for heating the water and debarked logs in said containing means with the heat from said generating means to a level sufficient to substantially eliminate infestation and fungi in said logs; and means for introducing the debarked logs into said containing means and for removing said debarked logs after the heat treatment is completed.

2. The apparatus of claim 1 further comprising means for connecting said heat generating means to said heating means.

3. The apparatus of claim 1 wherein said heating means includes a heat exchanger.

4. The apparatus of claim 1 wherein said containing means is substantially completely enclosed.

5. The apparatus of claim 1 wherein said containing means includes means for generating water flow within said containing means.

6. The apparatus of claim 1 wherein said heating means further comprises temperature and pressure control means.

7. The apparatus of claim 5 wherein said heating means comprises a plurality of heating coils.

8. The apparatus of claim 7 wherein said introducing and removing means is a crane.

9. The apparatus of claim 7 wherein said introducing and removing means is a continuous conveyor system.

10. The apparatus of claim 1 further comprising:

means for keeping the logs to be treated submerged below the surface of the water in said containing means.

11. The apparatus of claim 10 wherein said retaining means further comprises means for maintaining substantially equal spacing and flow around each of said logs in said retaining means.

12. The apparatus of claim 10 wherein said containing means further comprises a support for said retaining means.

13. The apparatus of claim 1 wherein said heat generating means further comprises a power plant of a ship.

14. The apparatus of claim 13 wherein said power plant is powered by fossil fuel.

15. The apparatus of claim 13 wherein said power plant is nuclear powered.

16. The apparatus of claim 15 wherein said ship is a submarine.

17. The apparatus of claim 1 wherein said containing means is a dry dock.

18. The apparatus of claim 13 wherein said containing means is a dry dock.

19. The apparatus of claim 15 wherein said containing means is a dry dock.

20. A method for the hot water treatment of logs to eliminate infestation and fungi therein, comprising the steps of:

providing a volume of water in a containment facility;

introducing a plurality of debarked logs into said containment facility;

heating said water for a time and temperature sufficient to substantially eliminate infestation and fungi therein; and thereafter removing said logs from said containment facility.

21. The method of claim 20 further comprising the step of submerging the debarked logs completely below the surface of the water in said containment facility.

22. The method of claim 20 wherein said heating step raises the temperature of the water to at least about 150° F.

23. The method of claim 20 wherein said introducing step introduces a continuous series of debarked logs into said containment facility in a consistent, regular, spaced orientation.

24. The method of claim 20 further comprising:

generating a current in the water in said containment facility.

25. The method of claim 20 wherein said heating step includes heating the water for a time and temperature sufficient to bring the temperature of the center of each of said logs to at least 56° C. for thirty minutes.

26. The method of claim 20 wherein said heating step further comprises:

operation of a power plant on a ship; and using the secondary steam generated from operation of said power plant to heat said water.

27. The method of claim 26 wherein said ship is nuclear powered.

28. The method of claim 27 wherein said nuclear powered ship is a submarine.

29. The method of claim 20 wherein said step of providing a volume of water is carried out using a dry dock.

* * * * *